United States Patent [19]

Smith

[11] Patent Number: 4,549,409

[45] Date of Patent: Oct. 29, 1985

[54] APPARATUS FOR COOLING BEVERAGE CONTAINERS AND THE LIKE

[76] Inventor: Jeffrey I. Smith, 5018 Dittmer St., #259, Davenport, Iowa 52804

[21] Appl. No.: 714,657

[22] Filed: Mar. 21, 1985

[51] Int. Cl.[4] ..... F25D 25/02

[52] U.S. Cl. ..... 62/381; 62/457

[58] Field of Search ..... 62/457, 381, 63, 466

[56] References Cited

U.S. PATENT DOCUMENTS

| | | | |
|---|---|---|---|
| 2,216,762 | 10/1940 | Bolas | 62/381 |
| 3,316,734 | 5/1967 | Crane, Jr. | 62/63 X |
| 4,078,397 | 3/1978 | Brande | 62/457 X |
| 4,164,851 | 8/1979 | Bryant | 62/62 |

*Primary Examiner*—Lloyd L. King

*Attorney, Agent, or Firm*—Henderson & Sturm

[57] ABSTRACT

Disclosed is a rapid cooler for beverages and the like cylindrical containers in which the container is rotated about its major or longitudinal axis within an ice-filled receptacle. The system involves confronting coaxial members facing each other and adapted to coaxially grip the container at its opposite ends. The members are carried by horizontal, rotatable shafts, one of which is driven, as by an electric motor, so that the container and both shafts and members are rotated to partake of the rapid chilling effect of the ice in the receptacle. The other shaft is axially slidably supported and is biased toward the driven shaft so as to effect gripping of the container as well as to accommodate containers of different heights or axial lengths.

7 Claims, 6 Drawing Figures

Fig. 1
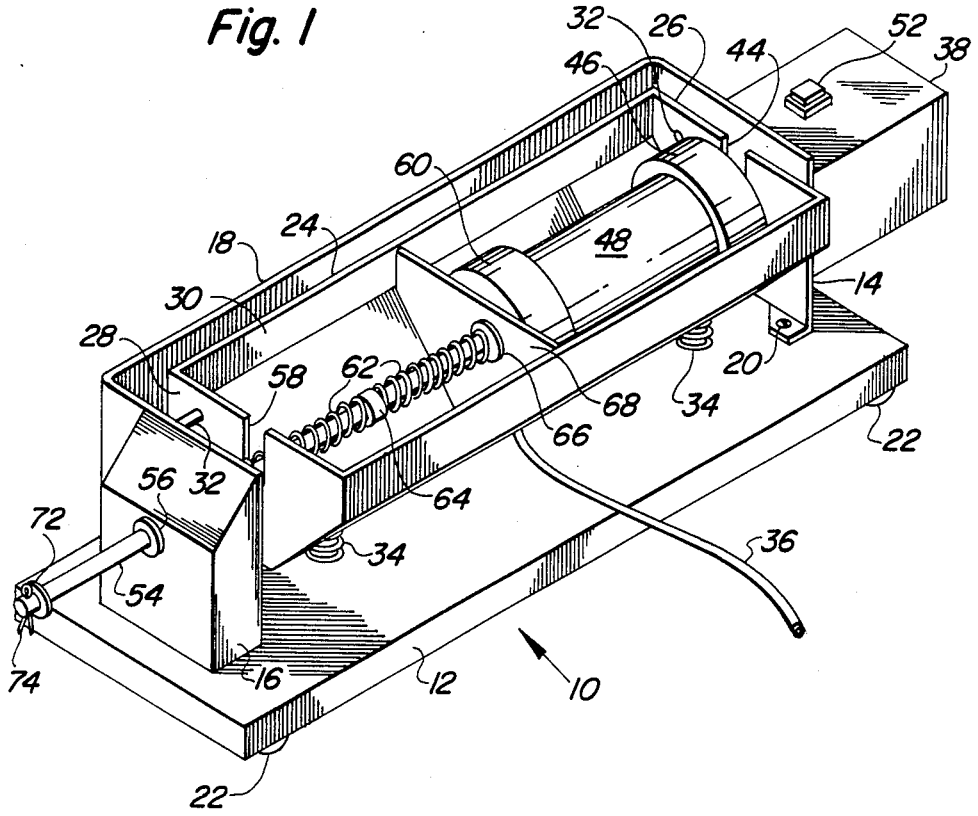
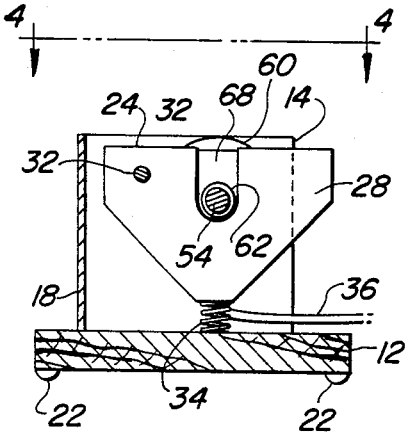
Fig. 3
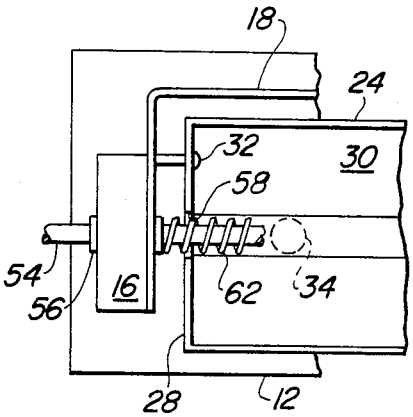
Fig. 4

APPARATUS FOR COOLING BEVERAGE CONTAINERS AND THE LIKE

BACKGROUND AND SUMMARY

The invention relates to the art of cooling cylindrical beverage containers, for example, by the process of rotating the container about its axis in the presence of, say, a bed of ice, which may be block, cubes or crushed, a basic principle which is well known and recently typified by the disclosure in the U.S. Pat. No. 4,164,851, to Bryant, wherein a beverage can is laid on its side atop a pair of parallel rollers by means of which rotation is imparted to the container.

The present invention departs in several novel areas from the teaching of the Bryant patent in that it provides coaxially spaced apart cup-like members for receiving a container there-between by gripping the container at its axially opposite ends and rotating same in a bed of ice carried in a tray or receptacle and in contact with the container. One member is carried by a motor-driven shaft and the other member is coaxially carried by a rotatable and axially slidable shaft that is spring-loaded toward the motor-driven member for two main purposes, one to grip the container, and, two, to enable axial shifting of the sliding shaft member to accommodate containers of different axial dimensions; e.g., convention soft drink, etc. cans and longer (higher) bottles of soft drinks, wine and the like. The spring-loading means comprises a pair of compression springs on the sliding shaft and abutting an intermediate collar, thus dividing the spring means into two components, one of which may be removed to enable axial shifting of the sliding shaft to a greater extent should longer containers be encountered. A further feature is the provision of a transverse partition slidable lengthwise relative to the shafts and receptacle to confine the ice to that portion of the tray that receives the can, thus preventing the ice from possible interference with the springs on the sliding shaft. A still further feature is the mounting of the tray or receptacle so that it may have limited up and down movement to prevent ice jamming during operation. The tray so mounted is carried in part by yielding means to cushion the tray and to urge it upwardly to a normal position.

Further features and advantages of the invention will appear as a preferred embodiment thereof is disclosed in detail (17) the ensuing description and accompanying drawings.

DESCRIPTION OF THE DRAWINGS

FIG. 1 is a perspective of the apparatus.

FIG. 3 is a section on the line 3—3 of FIG. 2.

FIG. 4 is a partial plan as seen along the line 4—4 of FIG. 3.

DISCLOSURE OF A PREFERRED EMBODIMENT OF THE INVENTION

Figure 2:
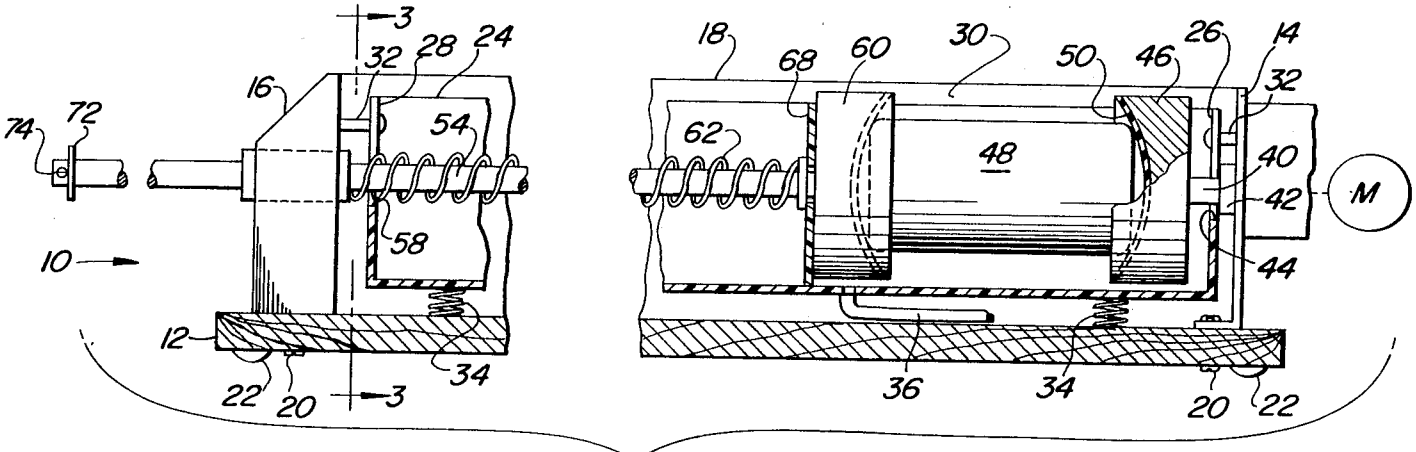
FIG. 2 is a longitudinal section with intermediate portions omitted so as to shorten the view.
Figure 6:
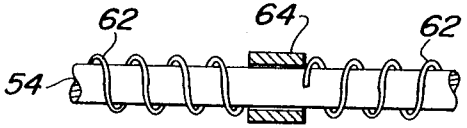
FIG. 6 is a fragmentary view showing the collar and spring relationship on the sliding shaft.

The apparatus is best shown in FIG. 1 as comprising supporting structure (10) having an elongated base (12) from which rise first and second upright supports (14) and (16). These are shown as being joined by a longitudinal rear wall (18). The base may be of wood or the like and the supports (14) and (16) and rear wall (18) may be integral, as being of cast aluminum, for example. Preferably corrosion-resistant materials are employed throughout. The end supports are shown as being affixed to the base by a plurality of screws (20) driven up from below. The bottom of the base is equipped with rubber buttons (22) to prevent marring of attendant surfaces. In the embodiment shown, the base may be on the order of eight inches wide by twenty-two inches long (plus or minus fractions of an inch). The end supports are about five inches high and the longitudinal spacing of the end supports is about twenty or so inches. These dimensions are given by way of example only and are not intended to delimit the invention. The same observation applies to the nature of the materials employed in the construction of the apparatus.

An elongated tray or receptacle (24), essentially U-shaped in section, is disposed between the supports (14) and (16). This tray has opposite ends (26) and (28) respectively closely adjacent to the supports (14) and (16) and preferably has an open top (30). The tray may be made of any suitable rigid plastic material or equivalent material in keeping with the overall design of light weight and long-lived materials. The tray is spring-suspended in the supporting structure, one such means for accomplishing this being a pair of coaxial longitudinal pivots (32) between the tray ends and the associated end supports. These enable the tray to have limited up and down movement, which is cushioned by resilient means including a pair of coiled compression springs (34) between the bottom of the tray and the top of the base (12). Equivalent means may of course be utilized. As will appear subsequently, the tray is adapted to contain ice in block, cube or crushed form and a drain tube (36) is provided for carrying off water from the melting ice.

The end support (14) carries outwardly thereof a motor compartment (38) within which is contained a small electric motor M (FIG. 2), preferably air-cooled and having an RPM of two hundred. This motor drives a first shaft (40) which is journaled in a bearing (42) in the support (14) for rotation about a horizontal axis lengthwise of the structure. This shaft extends into the receptacle or tray via the adjacent tray end wall, which is slotted at (44) for this purpose and also for accommodating spring-suspension of the tray. Within the tray, the shaft has affixed thereto an article-receiving member (46) adapted to coaxially abut and grip the adjacent end of a cylindrical beverage container, indicated here by way of example as a typical twelve-ounce can (48). The member is preferably circular and cup-like, having a concave face (50) facing the end of the can. This face may be coated with liquid rubber, for example, to improve its can-gripping qualities. An on-off switch (52) is used to control the motor M.

Figure 5:
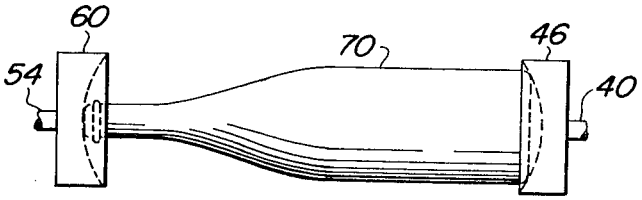
FIG. 5 is a reduced fragmentary elevation showing the container-receiving members carrying a long container.

A second shaft (54), coaxial with the shaft (40) is carried in the second support (16) by a bearing (56) of any suitable material, this bearing being elongated because it is the sole support of this shaft. The shaft is also free to slide axially in this bearing and its inner end extends into the tray (24) via a slot (58) in the tray end. The shaft has affixed to its terminal inner end, which stops short of the first shaft cup-like member (46), a mating cup-like member (60) which is configured to engage the opposite end of the can (48). Here again the face of the member (60), which is a mirror image of the member (46), may be coated with liquid rubber or its equivalent. The sliding shaft (54) and thus its member (60) are biased inwardly or toward the other cup-like member (46) via biasing means comprising a pair of coiled compression springs (62) separated by a sliding collar (64) on the shaft. One spring extends through the slot (58) in the tray end wall and abuts the bearing (56) at one end and the collar at its other end, while the other spring abuts the collar at one end and has its opposite end abutting a washer (66) which in turn abuts a transverse sliding partition (68) which has a central opening receiving the shaft and which is slidable along the shaft as the springs expand and contract along with outward or leftward movement of the cup-like member (60) according to the spacing between that member and the member (46), depending upon the length of inserted articles to be cooled. The partition is shaped to loosely fit the tray and serves to confine the ice to the compartment to the right of the partition as seen in the drawing. FIG. 5 illustrates a situation of spreading of the members (46) and (60) to accommodate a relatively long beverage bottle (70). It is possible to place two cans such as the can (48) end-to-end between the members. In the event increased spread of the members is required, one of the springs (62) can be removed. This is made possible by fitting the outer end of the shaft (54) with a washer (72) and cotter (74). Another option is that the partition may be omitted.

Operation of the apparatus should be apparent from the foregoing. One advantage of the coaxial members (46) and (60) is that the container, being rotated about its own axis, is not vibrated or shaken and thus does not aerate the contents. The construction and design result in a product that is simple and inexpensive to manufacture and market. The use of corrosion-resistant materials provides for long life free from breakdown. Advantages and features other than those pointed out will become apparent to those versed in the art, as will many modifications in the embodiment disclosed, all without departure from the spirit and scope of the invention.

I claim:

1. Apparatus for cooling essentially cylindrical articles such as beverage cans and bottles, comprising supporting structure including an elongated horizontal base having first and second longitudinally spaced apart first and second supports fixed to and rising therefrom, a horizontally extending, ice-receivable, open-topped receptacle extending between and having first and second ends respectively inwardly of and adjacent to the supports, means mounting the receptacle on the supporting structure, a first horizontal shaft journaled in the first support and extending rotatably into the receptacle via the first end of the receptacle, an article-receiving member fixed to the shaft within the receptacle, a second horizontal shaft coaxial with the first shaft and journaled and axially slidably carried in the second support and extending into the receptacle via the second end of the receptacle to a terminal end short of the first article-receiving member, a second article-receiving member fixed to the terminal end of the second shaft, said members respectively having confronting faces configured to receive coaxially between them the axially opposite ends of an article to be rotated within the receptacle, spring means biasing the second shaft axially toward the first shaft to grip the article between the members, and means for rotating the first shaft and thereby to rotate the article and second shaft and its member.

2. Apparatus as in claim 1, in which the means supporting the receptacle includes relatively movable cooperating elements respectively on the support structure and receptacle enabling limited up and down movement of the receptacle relative to the shafts, article and article-receiving members.

3. Apparatus according to claim 2, in which the elements include pivots between the ends of the receptacle and the supports and the pivots are coaxial on an axis parallel to the axis of the shafts.

4. Apparatus according to claim 2, in which the ends of the receptacle are configured to loosely receive the respective shafts so as to accommodate the up and down movement.

5. Apparatus according to claim 2, in which resilient means are interposed between the receptacle and supporting structure to cushion the movement of the receptacle.

6. Apparatus according to claim 1, including a transverse movable partition closely adjacent to the second article-receiving member and spanning the receptacle at the side of said member toward the second support and axially slidable on the second shaft and acted on by the spring means.

7. Apparatus as in claim 1, in which the spring means comprises a pair of coaxial compression springs carried by the second shaft intermediate the second member and the second end of the receptacle, and a collar axially slidable on the second shaft between the springs, said collar serving as a spacer between the springs and the springs abutting the collar from axially opposite sides.

* * * * *